US011047532B1

(12) United States Patent
Chen et al.

(10) Patent No.: US 11,047,532 B1
(45) Date of Patent: Jun. 29, 2021

(54) LED FLEXIBLE FILAMENT STRIP AND LED FLEXIBLE LAMP

(71) Applicant: HANGZHOU SKY-LIGHTING CO., LTD, Hangzhou (CN)

(72) Inventors: Leihua Chen, Hangzhou (CN); Qiaoming Liu, Hangzhou (CN)

(73) Assignee: HANGZHOU SKY-LIGHTING CO., LTD, Zhejiang (CN)

( * ) Notice: Subject to any disclaimer, the term of this patent is extended or adjusted under 35 U.S.C. 154(b) by 0 days.

(21) Appl. No.: 16/900,370

(22) Filed: Jun. 12, 2020

(30) Foreign Application Priority Data

Dec. 27, 2019 (CN) ..... 201922401006.0

(51) Int. Cl.

| | |
|---|---|
| ***F21K 9/232*** | (2016.01) |
| ***F21K 9/235*** | (2016.01) |
| ***F21S 4/24*** | (2016.01) |
| *F21Y 115/10* | (2016.01) |

(52) U.S. Cl.
CPC ..... *F21K 9/232* (2016.08); *F21K 9/235* (2016.08); *F21S 4/24* (2016.01); *F21Y 2115/10* (2016.08)

(58) Field of Classification Search
CPC ..... F21K 9/232; F21S 4/24; F21S 4/26
See application file for complete search history.

(56) References Cited

U.S. PATENT DOCUMENTS

| | | | | |
|---|---|---|---|---|
| 10,767,816 | B1 * | 9/2020 | Wu | F21V 29/86 |
| 2015/0009689 | A1 | 1/2015 | Chen et al. | |
| 2017/0012177 | A1 * | 1/2017 | Trottier | F21K 9/00 |
| 2017/0167667 | A1 | 6/2017 | Ma et al. | |

FOREIGN PATENT DOCUMENTS

| | | | |
|---|---|---|---|
| CN | 205480835 | U | 8/2016 |
| CN | 209782275 | U | 12/2019 |
| EP | 2292970 | A2 | 3/2011 |
| EP | 3726935 | A1 | 10/2020 |

* cited by examiner

*Primary Examiner* — Sean P Gramling
(74) *Attorney, Agent, or Firm* — Jason P. Mueller; FisherBroyles, LLP

(57) ABSTRACT

The present application discloses an LED flexible filament strip and an LED flexible lamp. Compared with the prior art, the light source is in the form of a flexible strip, realizing omnidirectional light emission through winding, so that various light colors can be more fully mixed and the problem of abrupt color lumps is avoided. The overall light distribution is more uniform, and a multi-angle light supplementing effect is realized, thus solving the problem that the back of a cuboid light source is opaque. Multiple dispersed light sources are concentrated on one flexible light filament, so that the number of solder joints for welding the positive and negative electrodes of the light source is reduced, and the risks of desoldering and faulty soldering are also reduced.

14 Claims, 6 Drawing Sheets

LED FLEXIBLE FILAMENT STRIP AND LED FLEXIBLE LAMP

This application claims priority to Chinese Patent Application No. 201922401006.0, filed Dec. 27, 2019, the entire contents of which is incorporated herein by reference.

TECHNICAL FIELD

The present application relates to the technical field of lamp bulbs, in particular to an LED flexible filament strip and an LED flexible lamp.

BACKGROUND

In the prior art, a filament light source in a bulb is cuboid, and the light emitting angle is usually limited within 120°, leading to uneven overall light distribution.

For other similar bulbs, some have multiple light sources, and each light source needs two solder joints, a positive one and a negative one. Therefore, in the case of multiple light sources, there are too many solder joints in actual production and use, and thus the risks of desoldering and faulty soldering are high. After multi-color mixing of multiple cuboid light sources (i.e. color diversity is achieved through mixing of several single colors), due to the limitation of light emitting angle of each single light source, blocky mixing of light colors exists, i.e. a certain single color stands out at a position corresponding to a certain light source, and soft change of light colors cannot be effectively realized.

In addition, since the back surface of the cuboid light source is opaque, such structure has insufficient light emission at the top and bottom of the bulb, which affects the light emission effect of the whole lamp.

SUMMARY

In order to solve the above technical problems, the embodiments of the present application provide an LED flexible filament strip and an LED flexible lamp.

A first aspect of the embodiments of the present application provides an LED flexible filament strip, which may comprise:

one or more monochromatic light source filaments and a flexible light-transmitting layer, wherein each monochromatic light source filament is wrapped with the flexible light-transmitting layer, and the monochromatic light source filaments are arranged in parallel to form a strip shape.

Further, the monochromatic light source filaments include at least three kinds of RGBCW light sources.

Further, the LED flexible filament strip comprises multiple monochromatic light source filaments having a single common positive electrode or a single common negative electrode.

A second aspect of the embodiments of the present application provides an LED flexible lamp, which comprises:

a housing serving as an outer cover of a lamp body;

a lamp holder internally provided with a control circuit and serving as an intermediary part for connecting filaments and a socket; and the LED flexible filament strip as described above, wherein the bottom of the filament strip is welded to the control circuit in the lamp holder, and an end of each monochromatic light source filament is separately connected to the control circuit.

Further, the lamp holder is provided with an upright post which is vertical at the center of the housing; and the filament strip is wound around the upright post, and a plurality of insulation wires for reinforcing the filament strip are arranged between the filament strip and the upright post.

Further, only one filament strip is wound around the upright post; a head end of the filament strip rises, from the lamp holder, towards a free end of the upright post in a positive spiral direction at a preset angle; and a tail end of the filament strip rises, from the lamp holder, towards the free end of the upright post in a reverse spiral direction at the same preset angle.

Further, at least two LED flexible filament strips are arranged side by side and wound together; a head end of each LED flexible filament strip rises, from the lamp holder, towards a free end of the upright post in a positive spiral direction at a preset angle; and a tail end of each LED flexible filament strip rises, from the lamp holder, towards the free end of the upright post in a reverse spiral direction at the same preset angle.

Further, the at least two LED flexible filament strips comprise monochromatic light source filaments of different colors, respectively.

Further, with the filament strip rising along the upright post, the strip-shaped front surface of the filament strip keeps facing the housing.

Further, the head end and the tail end of the filament strip are distributed on the two sides of the upright post, respectively.

Further, each insulation wire has an end fixed on the upright post and another end hooking the filament strip from top to bottom.

Further, the end, connected to the filament strip, of each insulation wire, is bent to form a closed shape.

Further, the end, connected to the filament strip, of each insulation wire penetrates through the filament strip.

Further, an end, connected to the filament strips, of each insulation wire, are bent to form a plurality of closed or semi-closed shapes allowing the at least two LED flexible filament strips to pass through respectively, and the number of the closed or semi-closed shapes formed at the end of each insulation wire corresponds to the number of the LED flexible filament strips.

Further, the LED flexible light also comprises:

a shock absorber connected between the upright post and the lamp holder.

Further, the shock absorber is a spring, which has an end fixed at the bottom of the upright post and another end fixed at the top of the lamp holder.

Further, the lamp holder is provided with a plurality of independent power connection wires extending from the top of the lamp holder and being connected to the filaments, respectively.

Further, the LED flexible filament strip comprises a plurality of monochromatic light source filaments having a single common positive electrode and a plurality of independent negative electrodes, and the lamp holder is provided with a single power connection wire extending from the top and connected to the single common positive electrode and a plurality of power connection wires extending from the top and connected to the plurality of independent negative electrodes; or the LED flexible filament strip comprises a plurality of monochromatic light source filaments have a single common negative electrode and a plurality of independent positive electrodes, and the lamp holder is provided with a single power connection wire extending from the top and connected to the single common negative electrode and a plurality of power connection wires extending from the top and connected to the plurality of independent positive electrodes.

In the embodiments of the present application, compared with the prior art, the light source is in the form of a flexible strip, realizing omnidirectional light emission through winding, so that various light colors can be more fully mixed and the problem of abrupt color lumps is avoided. The overall light distribution is more uniform, and a multi-angle light supplementing effect is realized, thus solving the problem that the back of a cuboid light source is opaque. The multiple dispersed light sources are concentrated on one flexible lamp strip, so that the number of solder joints for welding the positive and negative electrodes of the light source is reduced, and the risks of desoldering and faulty soldering are also reduced.

BRIEF DESCRIPTION OF THE DRAWINGS

In order to more clearly explain the embodiments of the present application or the technical scheme in the prior art, the following will briefly introduce the drawings needed in the description of the embodiments or the prior art. Obviously, the drawings in the following description are only for some embodiments of the application. Those ordinarily skilled in the art can obtain other drawings according to the following ones without creative labor.

REFERENCE SIGNS IN THE FIGURES

1—housing, 2—base, 3—filament strip, 4—insulation wire, 5—upright post.

DETAILED DESCRIPTION OF THE INVENTION

In order to make the objectives, features and advantages of the present application more obvious and understandable, the technical solution in the embodiments of the present application will be clearly and completely described below with reference to the drawings in the embodiments of the present application. Obviously, the embodiments described below are only illustrative ones, are not all possible ones of the present application. All other embodiments obtained by those ordinarily skilled in the art based on the ones in the description without creative labor should also fall within the protection scope of the present application.

The present invention will be further described below with reference to the accompanying drawings and specific embodiments.

It is to be understood that in the description of the present application, the terms such as "upper", "lower", "top", "bottom", "inner", and "outer" are used to indicate the orientation or positional relationship based on the drawings, only for the purpose of facilitating and simplifying the description of the present application, do not indicate or imply that the devices or elements referred to must have a specific orientation, or must be constructed and operated in a specific orientation, and therefore cannot be understood as limitations to the present application.

Figure 1:
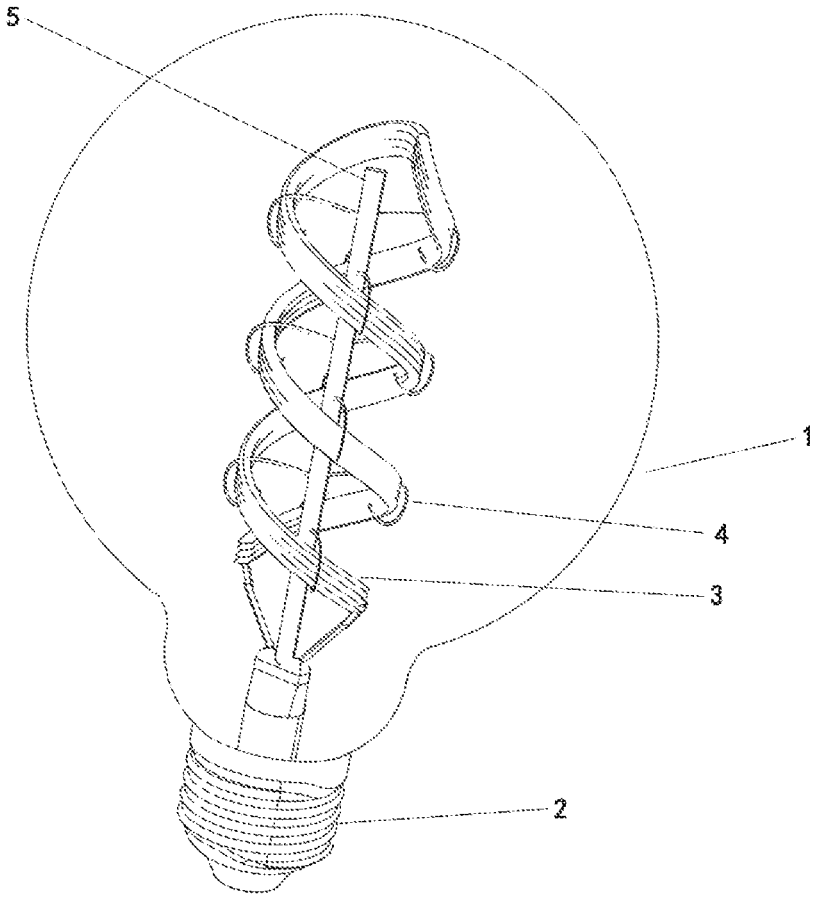
FIG. 1 is a perspective view of an LED flexible lamp in an embodiment of the present application.
Figure 2:
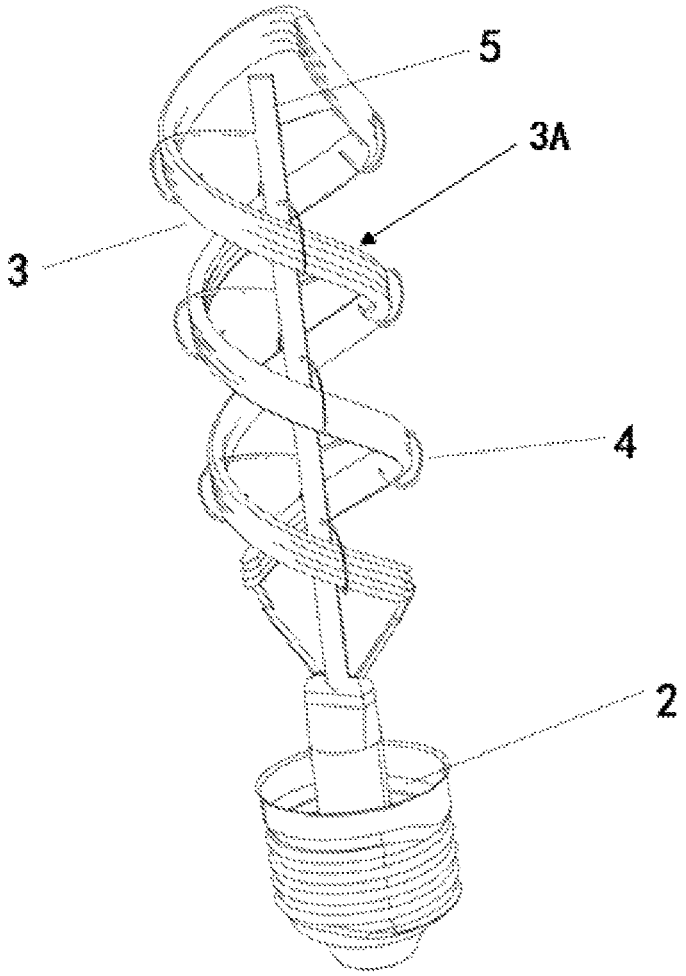
FIG. 2 is a structural diagram of the LED flexible lamp without a housing.

FIGS. 1 and 2 are diagrams of an LED flexible lamp with and without a housing, respectively. As shown in FIGS. 1 and 2, an LED flexible filament strip 3 in the present application structurally comprises a plurality of monochromatic light source filaments 3A and a flexible light-transmitting layer. Each monochromatic light source filament 3A is wrapped with the flexible light-transmitting layer (for example, formed of a Flexible Printed Circuit substrate), and the monochromatic light source filaments 3A are arranged in parallel to form the filament strip 3. The filament strip 3 formed in this way has high flexibility. Besides, monochromatic light sources in different colors can influence each other and complement each other in actual use, i.e., the brightness of each monochromatic light source filament 3A is changed by changing the current flowing through the monochromatic light source filament 3A, thereby obtaining other colors through mixing in addition to red, green and blue. In general, the flexible filament strip 3 comprises at least RGB (red, green and blue) monochromatic light source filaments as light sources, and may be additionally provided with at least one of CW (cold color and warm color) light sources.

According to an embodiment, a plurality of monochromatic light source filaments of the LED flexible filament strip 3 may have a single common positive electrode or a single common negative electrode. Therefore, the number of solder joints can be reduced, and the possibility of desoldering or faulty soldering can also be reduced. Specifically, when the LED flexible filament strip 3 has N (N is a positive integer) monochromatic light source filaments, these filaments may have a common positive electrode and N independent negative electrodes. Therefore, the number of solder joints can be reduced so as to reduce the possibility of desoldering or faulty soldering, and the monochromatic light source filaments in different colors can be controlled separately. It should be understood that the LED flexible filament strip 3 may also be provided with a common negative electrode and independent positive electrodes.

On the basis of the above-described filament strip 3, the present application also provides an LED flexible lamp, as shown in FIG. 1, comprising:

- a housing 1 serving as an outer cover of the lamp body;
- a lamp holder 2 internally provided with a control circuit and serving as an intermediary part for connecting filaments and a socket; and
- a filament strip 3, that is, the LED flexible filament strip 3 described above.

In the present application, the bottom of the filament strip 3 is welded to the control circuit in the lamp holder 2. Although a variety of light source filaments are used, solder joints only exist at both ends of each filament in the filament strip 3, which greatly reduces the number of solder joints, and the ends of the monochromatic light source filaments are separately connected to the control circuit to realize intelligent control.

The entire filament strip 3 is wound around an upright post 5 in the longitudinal direction, and the upright post 5 is vertical at the center of the housing 1 as a reference post. In general, the filament strip 3 should be symmetrically wound around the upright post 5, so that the stability of the whole filament strip 3 near the upright post 5 is strengthened. In order to further fix the positional relationship between the filament strip 3 and the upright post 5, a plurality of insulation wires 4 for reinforcing the filament strip 3 are arranged between the filament strip 3 and the upright post 5.

In the present embodiment, only one filament strip 3 is wound around the upright post. In this embodiment, a head end of the filament strip 3 rises, from the lamp holder, towards a free end of the upright post 5 in a positive spiral direction at a preset angle, and a tail end of the filament strip 3 rises, from the lamp holder, towards the free end of the upright post 5 in a reverse spiral direction at the same preset angle. On the whole, a rising spiral structure is formed. When the filament strip 3 rises along the upright post 5, the front surface of the strip shape of the filament strip 3 keeps facing the housing 1, so that the overall brightness is maximized.

In the present application, the insulation wires 4 are used as an auxiliary structure for hooking the filament strip 3. Generally, one end of each insulation wire 4 is fixed on the upright post 5, and the other end hooks the filament strip 3 from top to bottom to bear a part of the gravity of the filament strip 3. From an aesthetic point of view, the insulation wires 4 should be arranged at regular intervals.

Figure 3A:
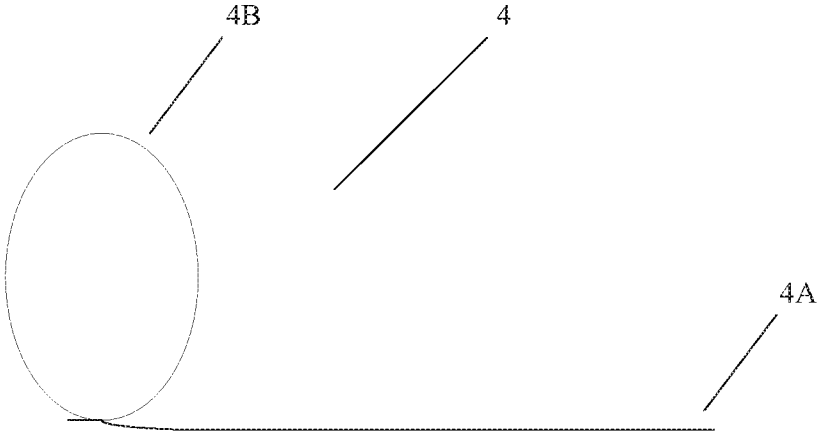
FIGS. 3A to 3C are shape diagrams of an insulation wire of the present application.
Figure 3B:
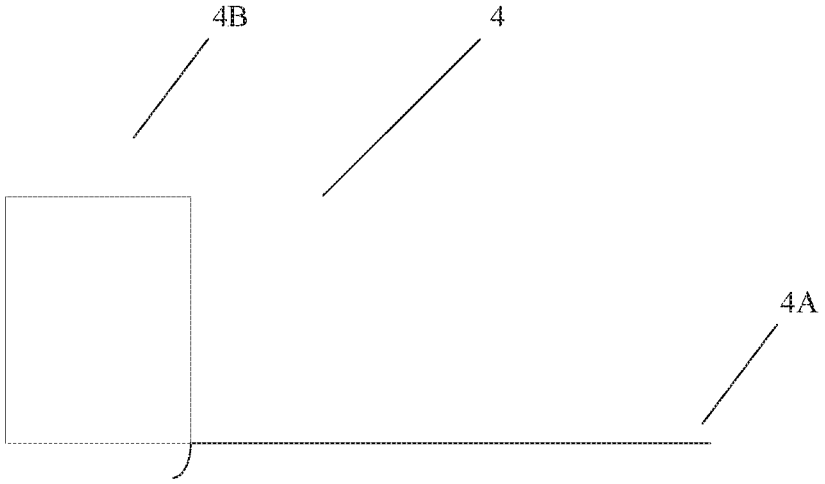
Figure 3C:
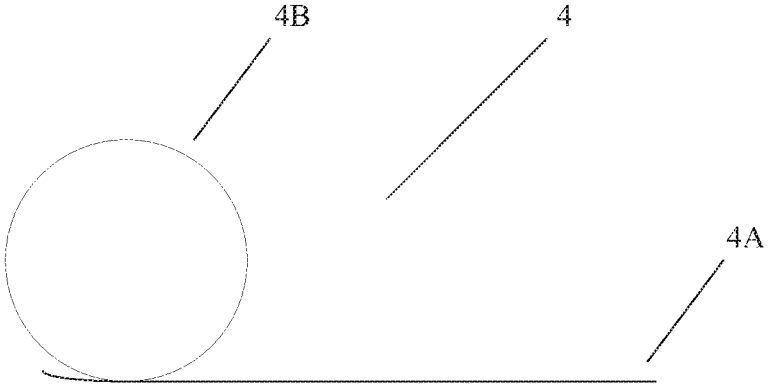

FIGS. 3A to 3C are shape diagrams of the insulation wires in the present application. As shown in FIGS. 3A to 3C, one end 4A of each insulation wire 4 is fixed to the upright post 5 (for example, by welding), and the other end 4B is used for fixing and bearing the filament strip 3. The end 4B of each insulation wire 4 may be approximately bent into a closed shape such as an oval shape (FIG. 3A), a rectangular shape (FIG. 3B), and circular shape (FIG. 3C), so as to enclose, contact and bear the filament strip 3. According to another embodiment, the end 4B of each insulation wire 4 can also penetrate through the filament strip 3 so as to fix and bear the filament strip 3.

Compared with the prior art, the present application has the following advantages:

1. The light source is in the form of a flexible strip, realizing omnidirectional light emission through winding, so that the overall light distribution is more uniform.
2. The multiple dispersed light source filaments are concentrated on one flexible filament strip, so that the number of solder joints for welding the positive and negative electrodes of the light source is reduced, and the risks of desoldering and faulty soldering are also reduced.
3. The multiple dispersed light source filaments are concentrated on one flexible filament strip, and various light colors can be more fully mixed through winding, so that the problem of abrupt color lumps is avoided.
4. The multiple dispersed light source filaments are concentrated on one flexible filament strip, and a multi-angle light supplementing effect is realized by winding, thus solving the problem that the back of a cuboid light source is opaque.

In addition, an intelligent control unit may be embedded in a base 2 of the present application to realize intelligent control.

As a specific embodiment, in the intelligent control unit, a ZIGBEE module may be used as a main control chip and a wifi module or Bluetooth module may be used as a connection module to a mobile terminal. The ZIGBEE module is connected to the control circuit through a radio frequency module.

In this way, users can connect a remote intelligent terminal to the ZIGBEE module, and control the operation of the circuit by controlling the radio frequency module through the ZIGBEE module, thus controlling each monochromatic light source and further realizing intelligent control.

Figure 4:
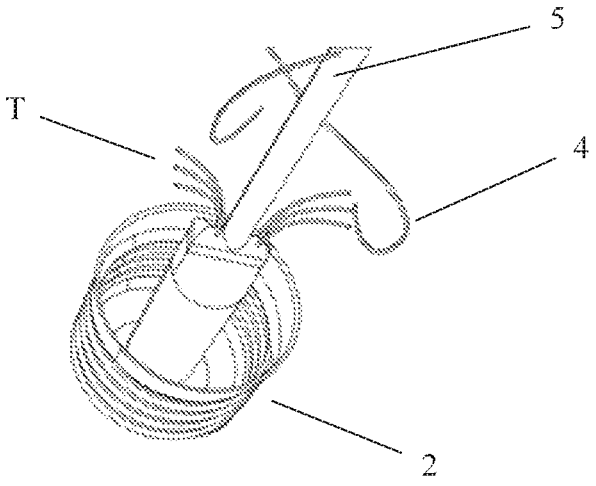
FIG. 4 is a diagram of a lamp holder as well as a part of an upright post and the insulation wires of the present application.

FIG. 4 is a diagram of the lamp holder as well as a part of the upright post and the insulation wires of the present application. As shown in FIG. 4, a plurality of independent power connection wires T extend from the top of the lamp holder 2, so as to be connected to filaments of different colors, respectively.

According to another embodiment, corresponding to the above embodiment having a single common positive electrode or common negative electrode, the power connection wires extending from the top of the lamp holder 2 may include a single power connection wire connected to the single common positive electrode and a plurality of power connection wires connected to a plurality of independent negative electrodes; or the power connection wires extending from the top of the lamp holder 2 may include a single power connection wire connected to the single common negative electrode and a plurality of power connection wires connected to a plurality of independent positive electrodes.

Figure 5:
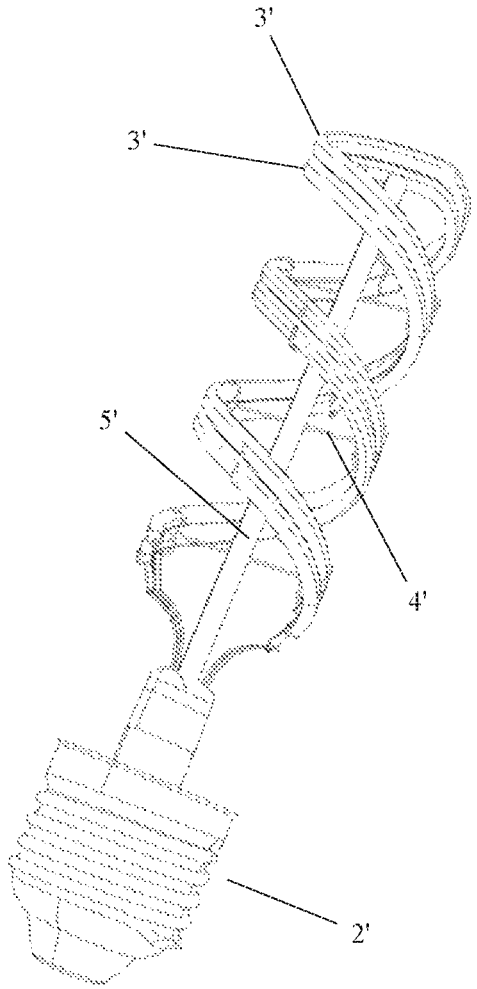
FIG. 5 is a schematic diagram of an LED flexible lamp in another embodiment of the present application.

FIG. 5 is a diagram of an LED flexible lamp in another embodiment of the present application. For the sake of clarity, a housing of the LED flexible light is omitted in FIG. 5. As shown in FIG. 5, in addition to the housing, the LED flexible lamp may further comprise a lamp holder 2' and a plurality of LED flexible filament strips 3'. The differences of the embodiment shown in FIG. 5 from that in FIGS. 1 and 2 will be detailed below. For the sake of brevity, the similarities will not be repeated here.

The main difference of the embodiment shown in FIG. 5 from the embodiment shown in FIGS. 1 and 2 is that in the embodiment shown in FIG. 5, the LED flexible lamp comprises at least two LED flexible filament strips 3', for example, two filament strips shown in FIG. 5. Each filament strip may comprise a plurality of monochromatic light source filaments and a flexible light-transmitting layer. For example, RGBCW monochromatic light source filaments can be divided into two groups, wherein the monochromatic light source filaments of two colors are in one group and arranged in one filament strip, and the monochromatic light source filaments of the other three colors are in another group and arranged in another filament strip, thus forming a "2+3" combination. Similarly, combinations of "4+1" and "2+2" can also be formed. In this way, filaments of different colors are arranged in different filament strips respectively to provide richer luminous effects and avoid interference between filaments of different colors.

The two LED flexible filament strips 3' shown in FIG. 5 are arranged side by side and wound together. To be specific, a head end of each LED flexible filament strip 3' rises, from the lamp holder 2', towards a free end of the upright post 5' in a positive spiral direction at a preset angle, and a tail end of each LED flexible filament strip 3' rises, from the lamp holder 2', towards the free end of the upright post 5' in a reverse spiral direction at the same preset angle.

According to an embodiment, an end, connected to the filament strips 3', of each insulation wire 4', are bent to form a plurality of closed or semi-closed shapes allowing the LED flexible filament strips 3' to pass through respectively, and the number of the closed or semi-closed shapes formed by bending each insulation wire 4' corresponds to the number of the LED flexible filament strips 3', so that the LED flexible filament strips can be better fixed in a lamp.

Figure 5A:
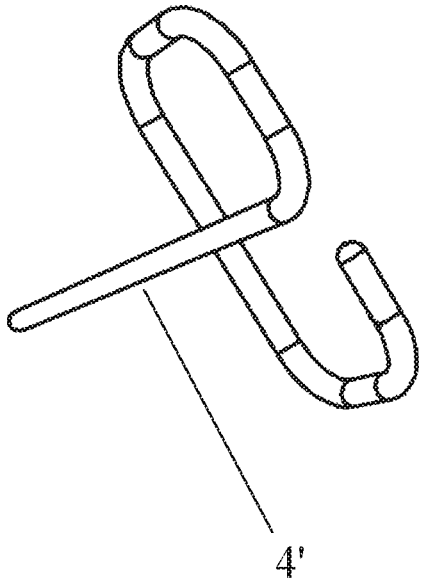
FIG. 5A is a perspective view of the insulation wire of the present embodiment.
Figure 5B:
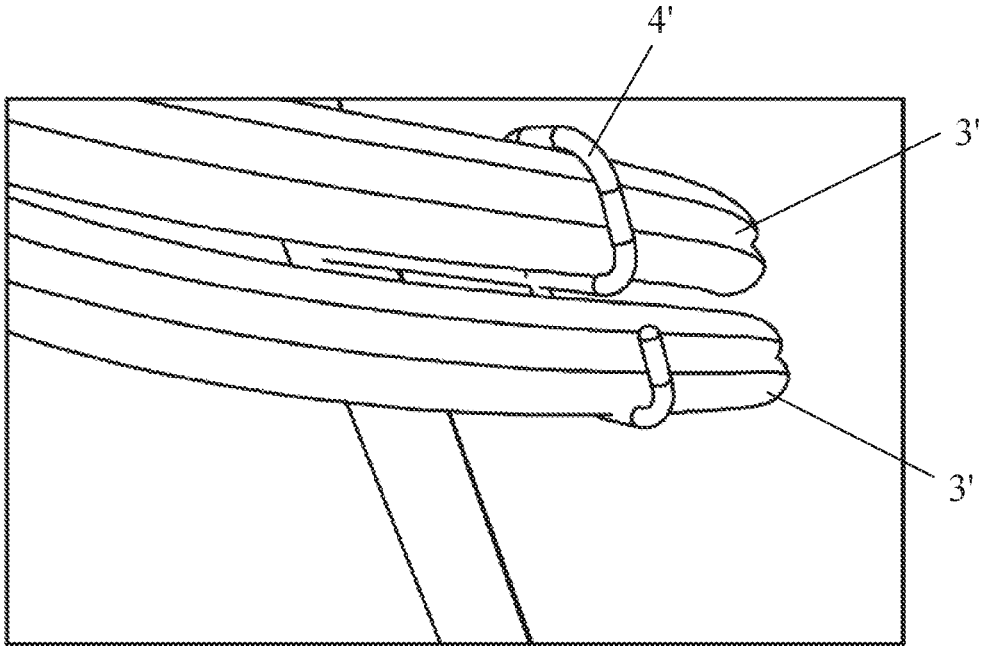
FIG. 5B is a partial enlarged view of filament strips and the insulation wire after assembly of the present embodiment.

FIG. 5A is a perspective view of the insulation wire of the present embodiment; and FIG. 5B is a partial enlarged view of the filament strips and the insulation wires after assembly in the present embodiment. As shown in FIGS. 5A and 5B, the ends, connected to the filament strips 3', of the insulation wires 4' are bent to form an "e" shape including an upper closed part and a lower semi-closed part to allow the two LED flexible filament strips 3' to pass through respectively.

Figure 6:
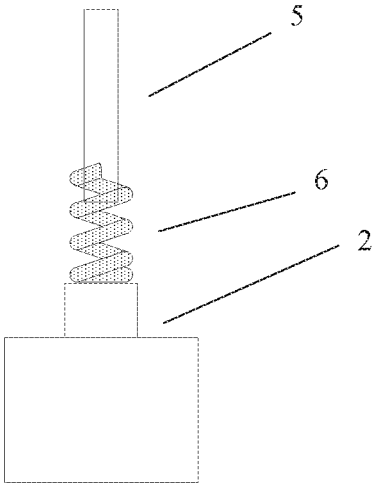
FIG. 6 is a connection diagram of the lamp holder and the upright post of the present application.

FIG. 6 is a connection diagram of the lamp holder and the upright post of the present application. As shown in FIG. 6, the upright post 5 can be indirectly supported by the lamp holder 2 via a shock absorber 6, so that when the housing 1 and the lamp holder 2 of the LED flexible lamp vibrate or shake due to an external force, the stress and movement amplitude of the upright post 5, the insulation wires 4 and the filament strips 3 can be reduced, thereby preventing the LED flexible lamp from being damaged. According to an embodiment, the shock absorber 6 may be a spring having one end fixed (e.g., by welding) at the bottom of the upright post 5 and another end fixed (e.g., by welding) at the top of the lamp holder 2, thereby realizing flexible connection between the lamp holder 2 and the upright post 5.

The preferred embodiments of the present invention have been described in detail above, but the present invention is not limited to the specific details in the above embodiments. Within the scope of the technical concept of the present invention, various equivalent transformations (such as number, shape and position) can be made to the technical scheme of the present invention, and all these equivalent transformations should be under the protection of the present invention.

What is claimed is:

1. An LED flexible lamp, comprising:

a housing forming an outer cover;

an LED flexible filament strip, comprising one or more monochromatic light source filaments and a flexible light-transmitting layer;

a lamp holder internally provided with a control circuit and configured as an intermediary part connecting the one or more monochromatic light source filaments to a power supply;

an upright post arranged on the lamp holder, wherein the upright post is vertical at a center of a space defined by the housing, and the LED flexible filament strip is wound around the upright post in a longitudinal direction;

a plurality of insulation wires arranged between the LED flexible filament strip and the upright post, the insulation wires configured to reinforce the LED flexible filament strip; and a shock absorber connected between the upright post and the lamp holder, wherein the shock absorber is a spring having an end fixed at a bottom of the upright post and another end fixed at a top of the lamp holder, wherein each of the one or more monochromatic light source filaments is wrapped with the flexible light-transmitting layer, wherein the one or more monochromatic light source filaments are arranged in parallel to form a strip shape, and wherein a bottom of the LED flexible filament strip is welded to the control circuit in the lamp holder, and an end of each of the one or more monochromatic light source filaments is separately connected to the control circuit.

2. The LED flexible lamp according to claim 1, wherein the one or more monochromatic light source filaments comprise at least two kinds of RGBCW light source filaments.

3. The LED flexible lamp according to claim 1, wherein the LED flexible filament strip includes a single common positive electrode or a single common negative electrode.

4. The LED flexible lamp according to claim 1, wherein:

a head end of the LED flexible filament strip rises, from the lamp holder, towards a free end of the upright post in a positive spiral at a preset angle; and a tail end of the LED flexible filament strip rises, from the lamp holder, towards the free end of the upright post in a reverse spiral at the same preset angle.

5. The LED flexible lamp according to claim 1, further comprising one or more additional LED flexible filament strips, wherein:

at least two LED flexible filament strips are arranged side by side and wound together;

a head end of each of the at least two LED flexible filament strips rises, from the lamp holder, towards a free end of the upright post in a positive spiral at a preset angle; and a tail end of each of the at least two LED flexible filament strips rises, from the lamp holder, towards the free end of the upright post in a reverse spiral at the same preset angle.

6. The LED flexible lamp according to claim 5, wherein the at least two LED flexible filament strips each comprise two or more monochromatic light source filaments having different colors, respectively.

7. The LED flexible lamp according to claim 4, wherein the head end and tail end of the LED flexible filament strip rises along the upright post such that a strip-shaped front surface of each of the head end and tail end of the LED flexible filament strip faces the housing.

8. The LED flexible lamp according to claim 4, wherein the head end and the tail end of the LED flexible filament strip are distributed on two sides of the upright post, respectively.

9. The LED flexible lamp according to claim 4, wherein each of the plurality of insulation wires has a first end fixed on the upright post and a second end hooking the LED flexible filament strip from top to bottom.

10. The LED flexible lamp according to claim 1, wherein an end, connected to the LED flexible filament strip, of each of the plurality of insulation wires, is bent to form a closed shape.

11. The LED flexible lamp according to claim 1, wherein an end, connected to the LED flexible filament strip, of each of the plurality of insulation wires penetrates through the LED flexible filament strip.

12. The LED flexible lamp according to claim 5, wherein an end, connected to the at least two LED flexible filament strips, of each of the plurality of insulation wires is bent to form a plurality of closed or semi-closed shapes allowing the at least two LED flexible filament strips to pass through the closed or semi-closed shapes respectively, and a number of the closed or semi-closed shapes formed at the end of each said insulation wire corresponds to a number of the at least two LED flexible filament strips.

13. The LED flexible lamp according to claim 1, wherein the lamp holder is provided with a plurality of independent power connection wires extending from the top of the lamp holder which are connected to the one or more monochromatic light source filaments, respectively.

14. The LED flexible lamp according to claim 1, wherein:

the LED flexible filament strip includes a single common positive electrode and a plurality of independent negative electrodes, and the lamp holder is provided with a single power connection wire extending from the top of the lamp holder and connected to the single common positive electrode, the lamp holder further including a plurality of power connection wires extending from the top of the lamp holder and connected to the plurality of independent negative electrodes; or the LED flexible filament strip includes a single common negative electrode and a plurality of independent positive electrodes, and the lamp holder is provided with a single power connection wire extending from the top of the lamp holder and connected to the single common negative electrode, the lamp holder further including a plurality of power connection wires extending from the top of the lamp holder and connected to the plurality of independent positive electrodes.

* * * * *